US006640671B2

(12) United States Patent
Frantz

(10) Patent No.: US 6,640,671 B2
(45) Date of Patent: Nov. 4, 2003

(54) TWO-WAY SOCKET DRIVE ADAPTER

(76) Inventor: Donnie W. Frantz, 101 Tanners Farm Rd., Ferris, TX (US) 75125

( * ) Notice: Subject to any disclaimer, the term of this patent is extended or adjusted under 35 U.S.C. 154(b) by 0 days.

(21) Appl. No.: 10/081,632

(22) Filed: Feb. 22, 2002

(65) Prior Publication Data

US 2003/0159548 A1 Aug. 28, 2003

(51) Int. Cl.[7] ..... B25B 23/16
(52) U.S. Cl. ..... 81/177.2; 81/177.85
(58) Field of Search ..... 81/177.85, 177.2

(56) References Cited

U.S. PATENT DOCUMENTS 5,168,782 A * 12/1992 Cromwell ..... 81/177.2
5,752,418 A * 5/1998 Robins ..... 81/177.2
5,860,338 A * 1/1999 Littlefield ..... 81/177.2

* cited by examiner

*Primary Examiner*—D. S. Meislin
(74) *Attorney, Agent, or Firm*—Robert H. Frantz

(57) ABSTRACT

A two-way socket drive adapter which can be switched from providing adaption in one drive size direction to adaption in a opposite drive size direction. For example, in one mode, the two-way drive adapter may receive a ½-inch drive boss of a ½-inch wrench, and provide a ⅜-inch drive boss to receive ⅜-inch sockets and accessories ("drive size down conversion mode"). With a slide of an internal core, the mode of the two-way adapter can be switched to receive the ⅜-inch drive boss of a ⅜-inch wrench, and to provide a ½-inch drive boss to receive ½-inch sockets and accessories ("drive size up conversion mode"). This allows each two-way drive adapter to perform the function of two, one-way drive adapters, thereby reducing the total number of adapters needed to cover a full range of applications by one-half.

8 Claims, 6 Drawing Sheets

*Prior Art*

TWO-WAY SOCKET DRIVE ADAPTER

TECHNICAL FIELD OF THE INVENTION

This invention relates to the field of hand tools, and especially to attachments and accessories for socket wrenches.

CROSS-REFERENCE TO RELATED APPLICATIONS

Not applicable.

FEDERALLY SPONSORED RESEARCH AND DEVELOPMENT STATEMENT

This invention was not developed in conjunction with any Federally sponsored contract.

MICROFICHE APPENDIX

Not applicable.

BACKGROUND OF THE INVENTION

Socket wrenches are common tools used by automotive mechanics, machinists, and repair personnel. A typical socket wrench (60) is shown in FIG. 6, which includes a handle (62), a main bar or shaft (61) and a head (63). Many socket wrenches are provided with a ratchet head, which assists in installing or removing nuts and bolts in a single direction.

The head (63) includes a drive boss or stud (64), typically of a square shape, for receiving a socket. Sockets and other attachments for the drive boss (64) are well known in the art, and include sockets for various sizes of nuts and bolt heads, "deep" sockets, adapters, etc. The drive boss (64) is usually equipped with a retention bearing (65), which is ordinarily a captive, spring-loaded ball bearing which provides a friction retention means for keeping a socket or other attachment secured to the drove boss (64) during use.

Socket wrenches are categorized by the size of the drive boss on them. For example, common SAE socket drive sizes are one-quarter inch, three-eighths inch and one-half inch. These measurements refer to the dimension of the side of the square drive boss.

Each socket set and accessory is provided with a square cavity for receiving the drive boss, so the cavity dimension must match the drive boss size in order for a socket or accessory to be usable on a particular wrench. Because these sockets and accessories can be costly to purchase, it is not practical to own multiple sockets of the same size for multiple wrench sizes. Therefore, many owners of socket wrenches and socket sets also own drive adapters (70), as shown in FIG. 7.

A drive adapter allows wrenches and sockets or accessories of differing (unmatched) drive boss size and reception cavities to be used together. The drive adapter (70) provides a reception cavity (72) of one size, and a drive boss (71) of a different size. For example, a one-half inch to three-eighths inch drive adapter would have a one-half inch compatible reception cavity (72) for attachment to a one-half inch socket wrench, and a three-eighths inch drive boss (71) for attachment of three-eighths inch sockets and accessories. These types of one piece drive adapters are well known in the art, and allow a broader range of sockets, accessories, and wrenches to be used in combinations otherwise not possible. This allows an owner of a set of sockets and wrenches to maximize the value of his tool investment.

However, a problem often arises when a tool user is searching for a particular adapter. For example, for the three common sizes of wrenches (½, ⅜ and ¼ inch), there are 6 possible adapters, as shown in Table 1. In a tray or drawer full of sockets and accessories, it can be time consuming to find a particular adapter. Further, many socket set owners do not own a full set of adapters for all the size combinations they have in wrenches and sockets.

TABLE 1

Drive Adapters for 3 Common Drive Sizes

| Reception Cavity Size | Drive Boss Size |
|---|---|
| one-half inch | three-eighths inch |
| one-half inch | one-quarter inch |
| three-eighths inch | one-half inch |
| three-eighths inch | one-quarter inch |
| one-quarter inch | three-eighths inch |
| one-quarter inch | one-half inch |

Therefore, there is a need in the art for a socket drive adapter which reduces the number of drive adapters necessary to cover a full range of combinations of sockets, accessories and wrenches. Further, there is a need in the art for a socket drive adapter which provides adaption in more than one direction to decrease the amount of time needed to find an appropriate adapter within a tray or drawer of a toolbox.

SUMMARY OF THE INVENTION

The present invention provides a two-way socket drive adapter which can be switched from providing adaption in one direction to another direction in sizes. For example, in one mode, the two-way drive adapter may receive a ½-inch drive boss of a ½-inch wrench, and provide a ⅜-inch drive boss to receive ⅜-inch sockets and accessories. This first mode can be referred to as "drive size down conversion mode". With a simple slide of an internal core, the mode of the two-way adapter can be switched to receive the ⅜-inch drive boss of a ⅜-inch wrench, and to provide a ½-inch drive boss to receive ½-inch sockets and accessories. This second mode can be referred to a "drive size up conversion mode". This allows each two-way drive adapter to perform the function of two, one-way drive adapters, thereby reducing the total number of adapters needed to cover a full range of applications by one-half.

BRIEF DESCRIPTION OF THE DRAWINGS

The figures presented herein when taken in conjunction with the disclosure form a complete description of the invention.

DETAILED DESCRIPTION OF THE INVENTION

The present invention is preferably realized using hardened steel or other suitable metal, but for certain low-force applications, plastics may be suitable as well. The two-way drive adapter may be cast, machined or milled to obtain the components described herein.

Figure 1:
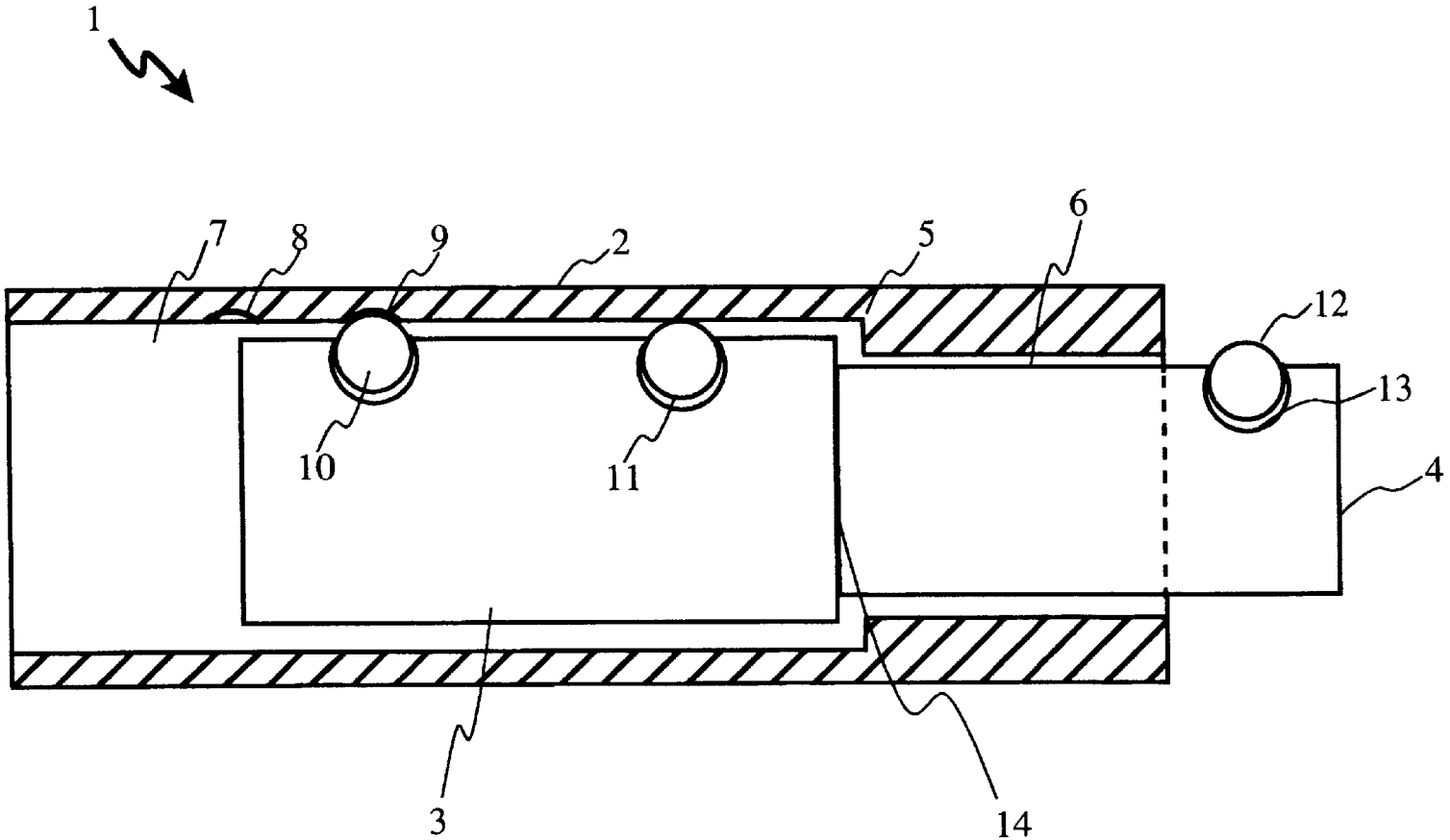
FIG. 1 illustrates a side cut-away view of the two-way drive adapter when set to the "drive size down conversion" mode.

Turning to FIG. 1, a side cut away view of the two-way drive adapter (1) is shown with the adapter in the "down conversion" mode. A round-shaped outer housing (2) is provided with a square-shaped channel through its length. The square-shaped channel has two sections, a larger section and a smaller section, separated by a channel shoulder (5). Slidably disposed in the channel is a square-shaped core having a larger section (3) and a smaller section (4), also separated by a core shoulder (14). The outer dimensions of the core are slightly less than the inner dimensions of the channel to allow for a friction-free fit.

In general, the core can be slid such that a portion of the small section (4) of the core is exposed to provide a small drive boss, and the open end of the larger portion of the channel is evacuated (just behind the core) to provide a reception cavity for a larger drive boss from a socket wrench or extension rod.

According to the preferred embodiment, a captive spring-loaded bearing (12) is provided on the exposable section of the smaller portion (4) of the core to help engage and hold a socket. Methods for producing such a captive bearing are well known in the art.

Also according to the preferred embodiment, a down conversion mode divot (9) is provided along the interior wall of the larger section of the channel to engage another captive bearing (10) to help hold the core in position for the down conversion mode. This allows the user to "snap" the core into place.

Further according to the preferred embodiment, the core shoulder (14) may engage the channel shoulder (5) to provide a positioning detente, as shown.

Figure 2:
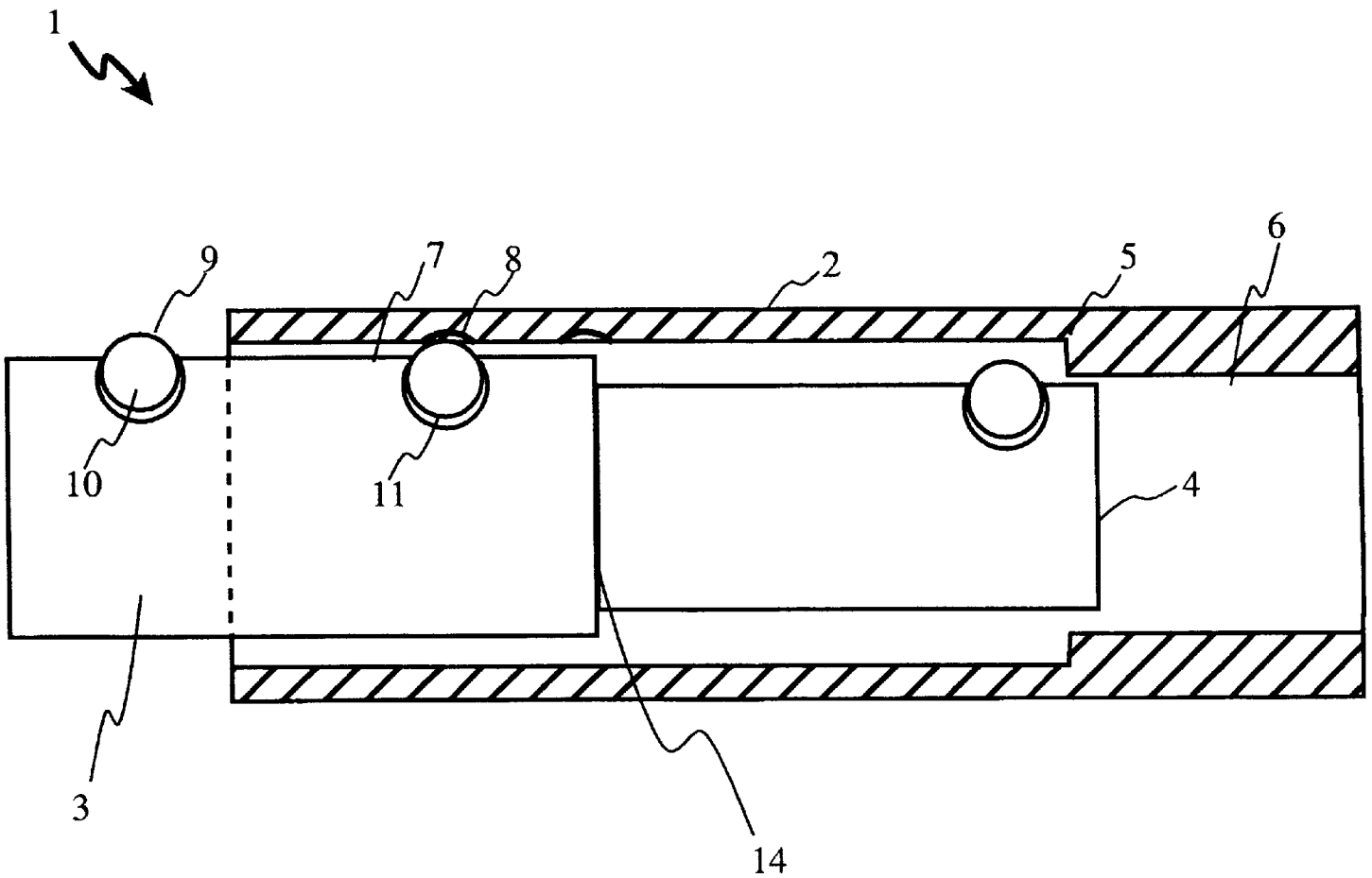
FIG. 2 shows a side cut-away view of the two-way drive adapter when set to the "drive size up conversion" mode.

Turning to FIG. 2, the cut away side view of the two-way adapter (1) shows the position of the core relative to the outer housing (2) in the up conversion mode. In this mode, the core is slid to the opposite extreme such that a portion of the large end (3) of the core is exposed to form a large drive boss for the reception of larger sockets and accessories. This causes a portion of the smaller section of the channel to be evacuated, allowing reception of a smaller drive boss from a socket wrench or extension rod.

The captive bearing (10) in the large end of the core provides a retention means when a larger socket is mounted to the large drive boss in this mode.

In the preferred embodiment, a third captive bearing (11) is provided which engages an up-size conversion divot (8) in the wall of the channel to help hold the core into the down conversion position.

Figure 4:
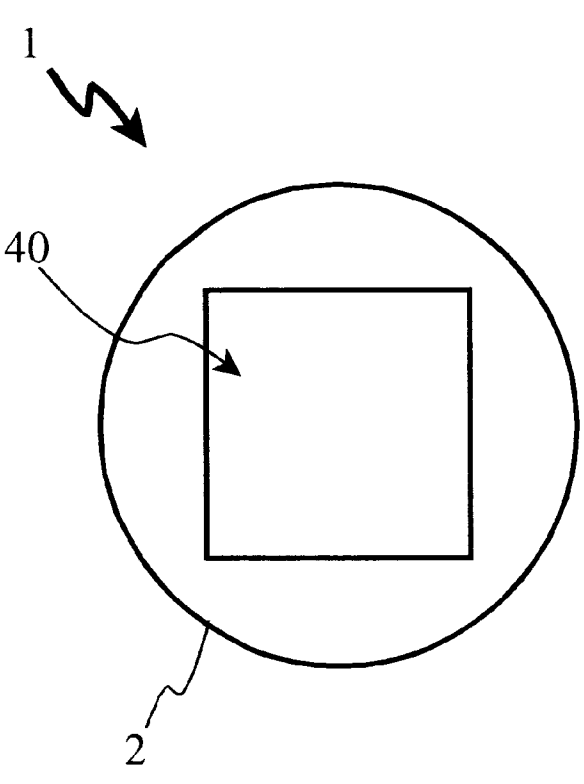
FIG. 4 shows a similar end view as FIG. 3, but taken from a view of the smaller of the two reception cavities.
Figure 3:
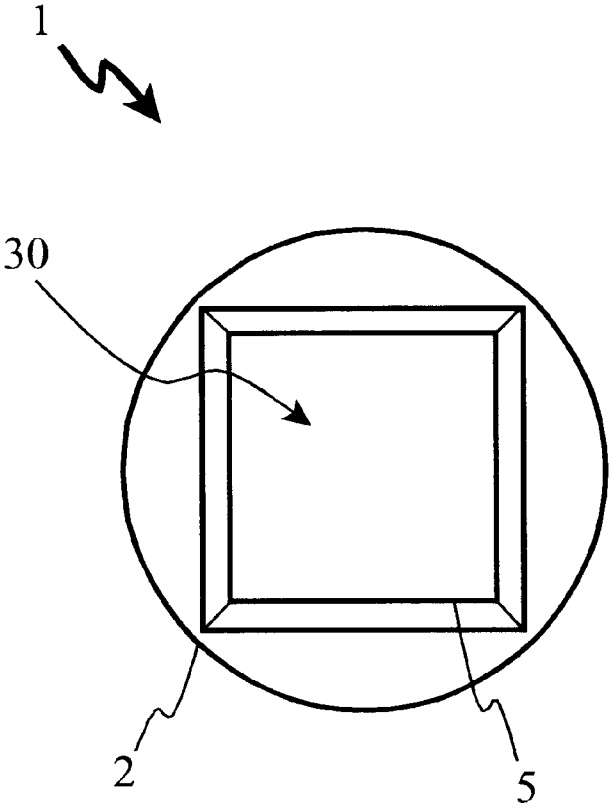
FIG. 3 shows an end view of the outer housing of the drive adapter taken from the angle of the larger of the two reception cavities.

FIG. 3 shows an empty outer housing (2) as viewed from the larger end (30) of the channel, which becomes the wrench drive boss reception cavity in the down conversion mode. Likewise, FIG. 4 shows the outer housing from a vantage point of the smaller end (40) of the channel, which becomes the wrench drive boss reception cavity in the up conversion mode.

Figure 5:
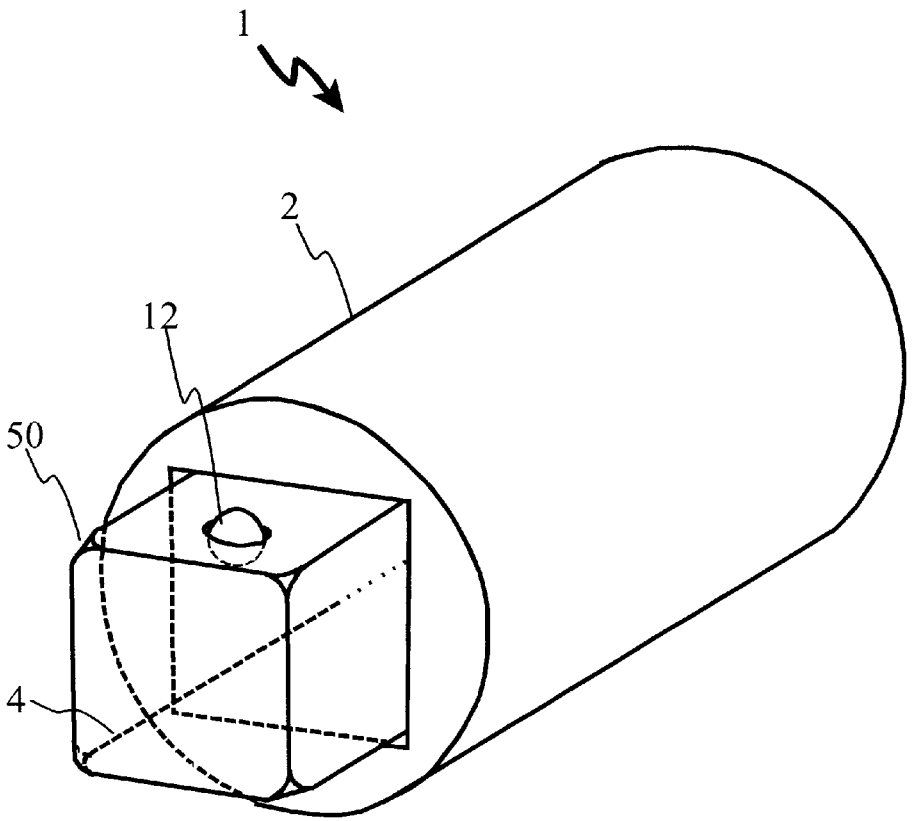
FIG. 5 shows a perspective view of the two-way drive adapter.
Figure 6:
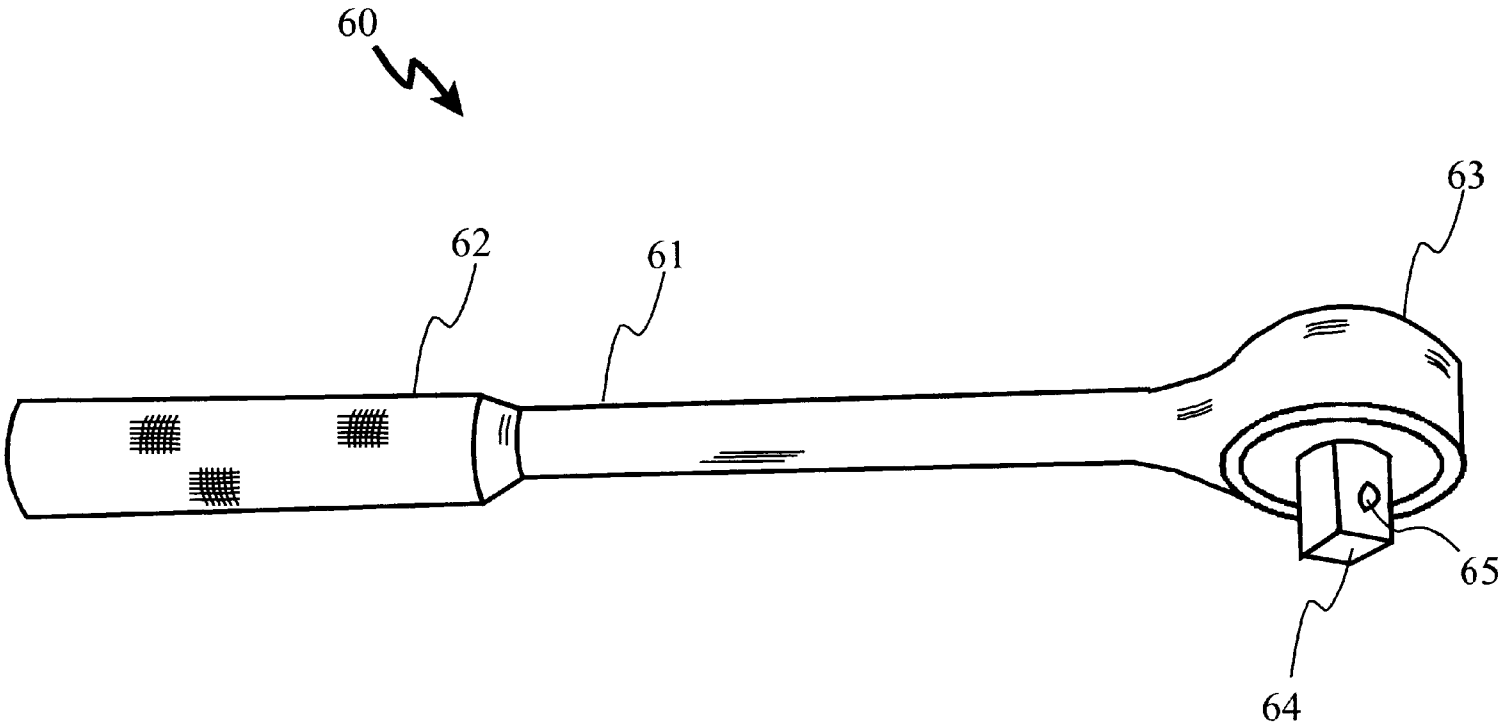
Prior Art Figure 6
FIG. 6 illustrates a typical socket wrench of the prior art.
Figure 7:
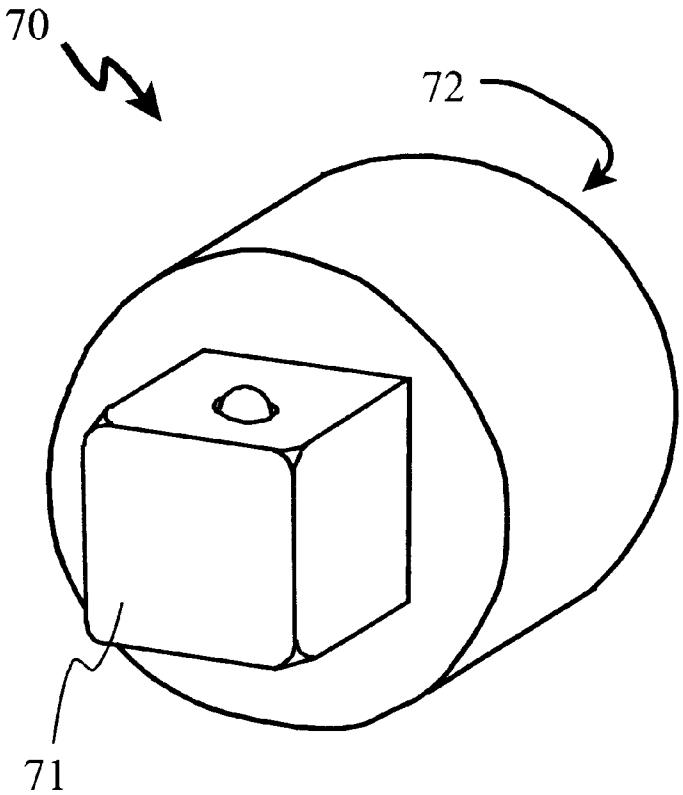
FIG. 7 illustrates a typical one-way drive adapter of the prior art.

Finally, FIG. 5 shows a perspective view of the two-way adapter with and exposed end (50) of the core providing a drive boss for receiving a socket or accessory, in this case the smaller end of the core in the down conversion mode. The view of the adapter from the boss when in up conversion mode is similar.

According to one embodiment for a one-half-inch to three-eighths-inch two-way socket drive adapter, the following approximate dimensions are used:

(a) length of outer body: 3 and 13/32 inches;

(b) width of square channel, larger section: 0.51 inches;

(c) width of square channel, smaller section: 0.385 inches:

(d) length of core larger section: 1 and 12/32 inches;

(e) width of core larger section: ½ inch;

(f) length of core smaller section: 1 and 14/32 inches; and (g) width of core smaller section: ⅜ inches;

Those skilled in the art will readily recognize that these dimensions are approximate, and exemplary of one particular embodiment for one particular two-way adapter, and that alternate dimensions may be adopted in order to realize other adapters and to accommodate manufacturing and materials tolerances and strength requirements. As such, details of the preferred embodiment as set forth herein should not be construed as limitations to the scope and spirit of the present invention whereas certain changes in structure, dimensions, and materials may be employed without departing from the spirit and scope of the present invention. The scope of the invention should be determined by the following claims.

What is claimed is:

1. A two-way drive adapter for adapting a drive boss of a socket wrench or extension rod having a first dimension to a drive boss of second, different dimension, said drive boss being suitable for reception of a socket or similar accessory, said adapter comprising:

an outer housing having a length, a first end, a second end and a width;

a two-section channel formed in the length of said outer housing, having a first channel section of a first width dimension defined by an interior surface disposed near said first end; and a second channel section having a second width dimension disposed near said second end, said first width dimension being larger than said second width;

a first divot formed proximate to said first end in said interior surface of said first section;

a second divot formed proximate to said first divot in said first section interior surface, said second divot being positioned farther from said first end than said first divot;

a two-section core removably and slidably disposed in said channel, having a large drive boss section of slightly less width than said first width dimension and a small drive boss section of slightly less width than said second width dimension such that said core may slide within said channel with minimal friction alternately into an up-size conversion position and a down-size conversion position; and said large drive bass section and small drive boss section being of similar lengths;

a first retention device disposed on said large drive boss section such that it is received by said second divot in said down-size conversion core position to removably retain said core into said housing, and disposed such that it is exposed outside said channel in said up-size conversion core position;

a second retention device disposed on said large drive boss section such that it is received by said first divot in said up-size conversion core position to removably retain said core into said housing in this position; and a third retention device disposed in said small drive boss section such that it is exposed outside said channel in said down-size conversion core position, thereby providing a two-mode drive boss size adapter having an up-size conversion mode and a down-size conversion mode.

2. A two-way drive adapter as set forth in claim 1 wherein said first, second and third retention devices comprise a captive spring-loaded ball bearings.

3. A two-way drive adapter as set forth in claim 1 said first and third retention devices are configured to retain a socket.

4. A two-way drive adapter as set forth in claim 3 wherein said first and third retention devices comprise a captive spring-loaded ball bearings.

5. A two-way drive adapter as set forth in claim 1 wherein said first width dimension is about one-half inch and said second width dimension is about three-eighths inch.

6. A two-way drive adapter as set forth in claim 1 wherein said first width dimension is about one-half inch and said second width dimension is about one-quarter inch.

7. A two-way drive adapter as set forth in claim 1 wherein said first width dimension is about one-quarter inch and said second width dimension is about three-eighths inch.

8. A two-way drive adapter as set forth in claim 1 wherein said channel is a substantially square channel and said core is substantially square in shape.

* * * * *